United States Patent [19]

Schmidt

[11] 4,367,878

[45] Jan. 11, 1983

[54] GOLF CLUB HEAD

[76] Inventor: Glenn H. Schmidt, 1857 Los Encinos, Glendale, Calif. 91208

[21] Appl. No.: 255,686

[22] Filed: Apr. 20, 1981

[51] Int. Cl.[3] ..... A63B 53/04

[52] U.S. Cl. ..... 273/175; 273/167 H; 273/164

[58] Field of Search ..... 273/77 R, 78, 164, 167–175

[56] References Cited

U.S. PATENT DOCUMENTS

| | | | |
|---|---|---|---|
| 1,299,014 | 4/1919 | O'Hara | 273/175 X |
| 2,023,885 | 12/1935 | Hinckley | 273/175 X |
| 2,395,837 | 3/1946 | Baymiller et al. | 273/175 |
| 3,172,667 | 3/1965 | Baker et al. | 273/175 X |
| 3,368,812 | 2/1968 | Baldwin | 273/175 X |
| 3,625,518 | 12/1971 | Solheim | 273/175 |
| 3,989,257 | 11/1976 | Barr | 273/175 |
| 4,139,196 | 2/1979 | Riley | 273/164 |

*Primary Examiner*—George J. Marlo
*Attorney, Agent, or Firm*—William W. Haefliger

[57] ABSTRACT

A golf club wood head has a front face with bulge curvature defined by the intersection of generally horizontal planes normal to the front face, those intersections defining curved lines which are generally parabolic. The front face also has curved lines in a vertical plane resulting in a compound curvature, and the front face intersects the uppermost frontal portion of the head along a generally straight line, when viewed downwardly from a position above the front face.

5 Claims, 9 Drawing Figures

GOLF CLUB HEAD

BACKGROUND OF THE INVENTION

This invention relates generally to golf clubs, and more particularly to "wood" heads.

A common problem in golf is the slice produced as a result of striking the ball off-center relative to the centered sweet spot at the front face of a "wood" (driver, brassie, spoon, etc.). While front faces have been made with circular curvature, the unwanted "slice", and also "hook" remain as problems. A further difficulty is that of fabricating the wood to maintain a non-complexly curved line of intersection between the front face and the upper portion of the head.

SUMMARY OF THE INVENTION

It is a major object of the invention is to provide an improved "wood" head that combines the objective of increasing the self-correcting spin of the ball with the desired visual effect of a straightened top line intersection of the head front face with the head top. Basically, the head is characterized by (a) the front face having bulge curvature defined by the intersections of generally horizontal planes normal to the front face, (b) such intersections defining curved lines which are generally parabolic.

As a result, the ball struck off-center by that parabolic face is given a spin-rotation that tends to more effectively pull the ball's line of flight back toward the desired straight path, than for a circularly curved front face.

As will appear, the parabolically curved lines have foci rearwardly of the center of the front face; and the front face intersects the uppermost frontal portion of the head along a substantially straight line, which lessens the difficulty of fabrication. Further, the front face may also have roll curvature defined by intersections of forwardly extending vertical planes with the parabolically bulge-curved front face, and the roll curvature may also be parabolic.

In addition, the wood head may consist of a wooden body with a metallic sole plate, or a metallic shell containing solid non-metallic filler.

These and other objects and advantages of the invention, as well as the details of an illustrative embodiment, will be more fully understood from the following description and drawings in which:

DRAWING DESCRIPTION

Figure 2:
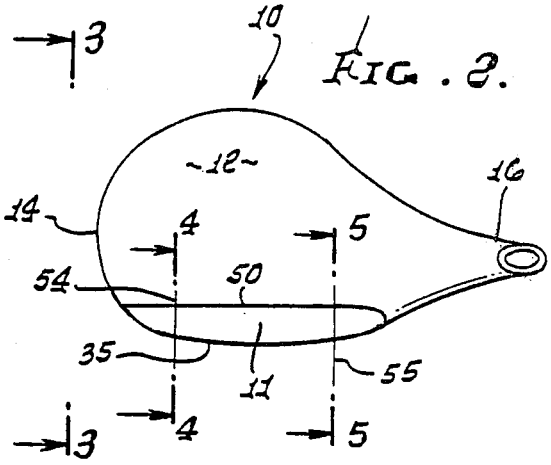
FIG. 2 is a top plan view of a golf wood head incorporating the invention.
Figure 3:
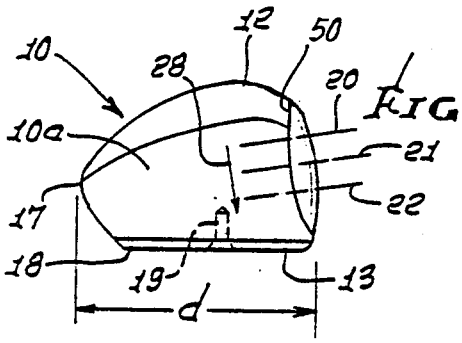
FIG. 3 is a vertical section on lines 3—3 of FIG. 2.
Figure 6:
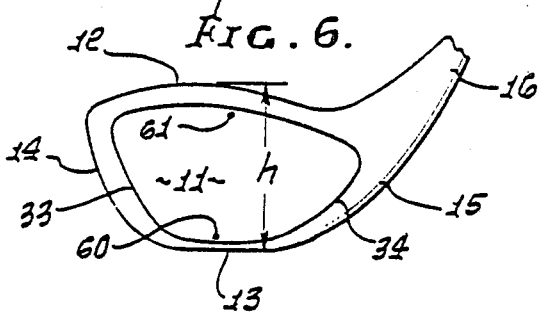
Figure 4:
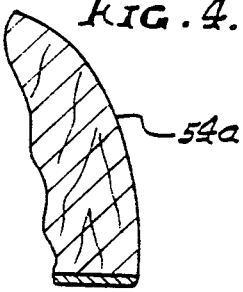
Figure 5:
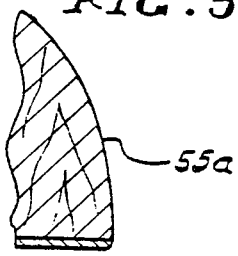
Figure 7:
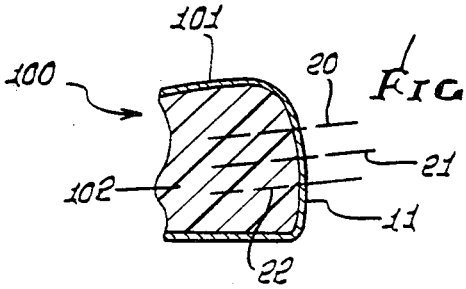

FIGS. 4 and 5 are fragmentary vertical section on lines 4—4 and 5—5, respectively of FIG. 2;

FIG. 6 is a perspective view of a golf wood head front face, incorporating the invention;

FIG. 7 shows a modified head, fragmentary section like FIG. 3, and

Figure 8:
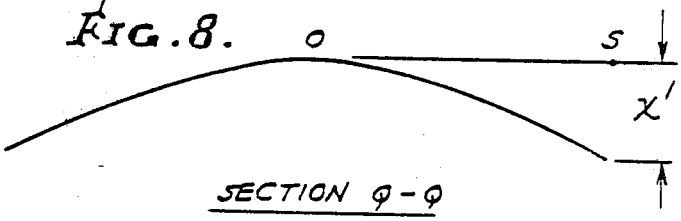
Figure 9:
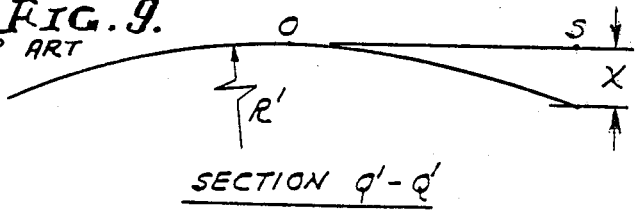
FIG. 9. PRIOR ART

FIGS. 8 and 9 are sections showing front face curvatures.

DETAILED DESCRIPTION

In FIGS. 2, 3 and 6, the golf club head 10 comprises a "wood", which may be made of wood or metal, but is "wood" shaped, such as a driver, brassie, spoon, etc. The head has a front face 11 adapted to strike a golf ball, upper and lower surfaces 12 and 13, a toe 14, heel 15 and a hosel 16. The rear surface 17 of the club head is maximally spaced rearwardly from front face 11 at a distance "d" in FIG. 3 which is substantially greater than the head height "h", in FIG. 6.

The head 10 may consist of a wooden body 10*a*, with a metallic sole plate shown at 18. The latter may be suitably attached to the body as by a fastener or fasteners 19. Alternatively, the modified head shown at 100 in FIG. 7 consists of a hollow metallic shell 101 (as for example steel), and contains a solid filler, such as plastic 102. Its front face 11 has the same shape as front face 11 in FIG. 3.

Figure 1:
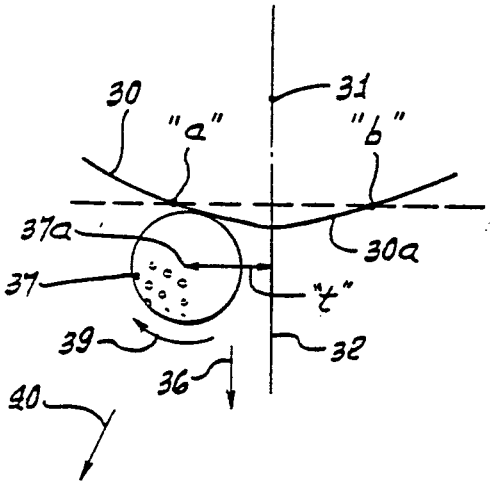
FIG. 1 is a schematic showing of a parabolic surface striking a golf ball.

The front face 11 is characterized as having bulge curvature defined by the intersections of generally horizontal planes tilted to be normal to that face. See for example edge-viewed planes 20–22 in FIG. 3. Further, such intersections define curved lines which are parabolic, in FIG. 3. One such curved line is seen in FIG. 8 and designated section Q—Q, it being viewed in the direction of arrow 28 in FIG. 3. FIG. 1 shows a view of a parabola 30 in such a plane, and having a focus at 31. A parabolic curved line segment 30*a* extends from point "a" to point "b", equidistant from a line 32 symmetrically bisecting the parabola to define its axis. Parabolic segment 30*a* corresponds to the curved line segments defined by the intersections of planes 20–22, (and other planes over the height of the front face 11); however, such intersections may have different horizontal lengths, due to the roll curvature of front face 11 and the endwise delineation of front face 11 by end curves 33 and 34 in FIG. 6, for example. The forwardmost such parabolic segment appears at 35 in FIG. 2. The focus of the parabola appears at 31 and is rearward of the center of the front face 11.

Referring again to FIG. 1, and considering that the segment 30*a* is a parabolic wall traveling in the forward direction of arrow 36, it is shown striking a golf ball 37 whose center 37*a* is offset by a distance "t" from the center line 32 which is parallel to arrow 36. The ball is given an intensified spin rotation (indicated by arrow 39) as the ball is driven forwardly. While the ball is nominally driven in the direction of arrow 40 angled from the direction of arrow 36, the ball clockwise spin rotation tends to correct for such deviation and to pull the ball back toward the direction of arrow 36 due to the interaction of the spinning ball with the air through which it travels. As a result, the fact that the ball is struck "off center" relative to segment 30*a* (or relative to the center of front face 11 in FIGS. 3 and 7) is of less concern toward the production of an unwanted "slice", due to the fact that the use of a parabolic face tends to produce a compensating effect, as described. If the ball is struck off-center at the opposite side of line 32, a similar rotation of the ball in counter-clockwise mode is produced, to produce compensation tending to pull the ball direction of travel back toward the direction 36. Therefore, the result of mis-aligning the wood with the ball is of less undesirable consequence than with conventionally circularly curved head faces, due to the intensified spin imparted to the ball by the club head of the present invention.

As a further result of the use of a parabolic bulge, the front face 11 intersects the uppermost frontal portion of the head along a substantially straight line, as indicated by top line TL 50 in FIG. 2. This facilitates easier fabrication of the head and front face, since that line of intersection is not complexly curved as is the case when the front face has circular curvature. See FIG. 9 showing such circular curvature in a section Q'—Q' corresponding to section Q—Q of FIG. 8.

Finally, the front face 11 may also have roll curvature defined by intersections of forwardly extending vertical planes (see for example planes 54–55 in FIG. 2). Such linear intersections (see at 54*a*, and 55*a* in FIGS. 4 and 5) are forwardly convex, and are typically parabolic in FIGS. 4 and 5. Such construction causes the ball to spin-compensate for being struck above or below the sweet spot (say at points 60 or 61 in FIG. 6), so as lessen the chances of the ball failing to get off the ground, or rising too high in its flight path.

FIG. 8 shows a parabolic curve, with crest at 0, and representative of an intersection of a head front face with a plane indicated at 22 in FIG. 3. FIG. 9 is a view like FIG. 8, but showing a comparable circular curve, as used in the prior art. The nominal radius of the FIG. 9 circle is indicated at R'. At a distance O S from the crests in FIGS. 8 and 9, on lines tangent to those crests, the curves of FIGS. 8 and 9 are spaced at drop-back distances indicated at X' and X, from points S. Representative X and X' distances are as shown in the following table:

| X | X' |
|---|---|
| .088" (at R' = 10") | .148" |
| .080" (at R' = 11") | .127" |
| .073" (at R' = 12") | .110" |
| .068" (at R' = 13") | .098" |
| .063" (at R' = 14" | .095" |
| .059" (at R' = 15") | .010" |

The table shows that for a parabolic section, the drop back is greater than for the radial section, which further indicates that greater self-correcting spin is given the ball by the parabolic surface, where the ball is struck a given distance from the club center.

I claim:

1. In a golf wood head having a heel, toe, top surface, bottom surface, a rear side and a front face to strike a ball, the improvement comprising (a) said front face having bulge curvature defined by the line intersections of parallel planes normal to said front face and inclined downwardly and rearwardly relative to the horizontal, at a shallow angle, (b) said intersections defining curved lines which are parabolas, when viewed from a position above the club head and spaced rearwardly of a line normal to said bottom surface, whereby the front face as defined is tilted rearwardly, (c) said front face also having roll curvature defined by intersections of forwardly extending vertical planes with said front face, said last named intersections defining curved lines which are forwardly convex, (d) the forwardmost parabolic curved line having a focus which is in direct rearward alignment with the center of said front face, (e) said front face having compound curvature as defined and intersecting the uppermost frontal portion of the head along a generally straight line when viewed downwardly from a position above said front face.

2. The improvement of claim 1 wherein said curved lines defined in sub-paragraph (c) are parabolic.

3. The combination of claim 1 wherein the head comprises a wood body and a metallic sole plate.

4. The combination of claim 1 wherein the head comprises a hollow metallic shell, and has an inert filler in the hollow defined by the shell.

5. The combination of claim 1 wherein the front to rear dimension of the head exceeds the top to bottom surface dimension of the head.

* * * * *